US007828118B2

(12) United States Patent
Barbara

(10) Patent No.: US 7,828,118 B2
(45) **Date of Patent: *Nov. 9, 2010**

(54) PORTABLE RAILCAR STEP AND RAILCAR THEREWITH

(75) Inventor: Jonathan A. Barbara, Toledo, OH (US)

(73) Assignee: Coug Enterprises, Inc., Blacklick, OH (US)

( * ) Notice: Subject to any disclaimer, the term of this patent is extended or adjusted under 35 U.S.C. 154(b) by 198 days.

This patent is subject to a terminal disclaimer.

(21) Appl. No.: 11/900,588

(22) Filed: Sep. 12, 2007

(65) Prior Publication Data

US 2008/0060545 A1 Mar. 13, 2008

Related U.S. Application Data

(63) Continuation-in-part of application No. 11/520,536, filed on Sep. 13, 2006.

(51) Int. Cl.
*B61D 23/00* (2006.01)

(52) U.S. Cl. ..... 182/127; 182/90; 182/92; 105/443; 248/205.1; 280/163

(58) Field of Classification Search ..... 182/127, 182/92, 90; 248/229.22, 228.3, 231.41, 316.4; 105/355, 460, 461, 443, 449; 280/163, 164.1, 280/164.2, 166, 169
See application file for complete search history.

(56) References Cited

U.S. PATENT DOCUMENTS 504,856 A * 9/1893 Aichner ..... 269/87.1
822,809 A * 6/1906 Young ..... 108/1
1,061,100 A * 5/1913 Mitchell ..... 182/99
1,829,324 A * 10/1931 Aland et al. ..... 182/58
1,963,796 A * 6/1934 Lehman ..... 182/60
2,024,940 A * 12/1935 Miksovie ..... 182/60
2,204,163 A * 6/1940 Steuber ..... 182/90
2,226,489 A * 12/1940 Doherty ..... 182/90
2,445,188 A * 7/1948 Sasgen ..... 269/157
2,805,103 A * 9/1957 Jovais ..... 182/60
H421 H * 2/1988 Glommen ..... 280/169
4,869,520 A 9/1989 Cole
4,911,264 A 3/1990 McCafferty
5,139,295 A 8/1992 Escobedo
5,386,784 A 2/1995 Meier
5,529,144 A * 6/1996 Henderson ..... 182/3
5,743,191 A 4/1998 Coslovi
6,162,270 A * 12/2000 Nystrom et al. ..... 55/385.2
2006/0260504 A1 11/2006 McCrary

* cited by examiner

*Primary Examiner*—Katherine W Mitchell
*Assistant Examiner*—Daniel Cahn
(74) *Attorney, Agent, or Firm*—Goodman Allen & Filetti PLLC

(57) ABSTRACT

A railcar step mounts to the stirrup of a rail vehicle. The railcar step comprises a support sized to support a rail worker. A coupling is supported in relation to an end of the support. The coupling is sized and configured to hold the support in fixed relation to the stirrup. The support is sized to extend outward beyond the rail vehicle and support a rail worker.

13 Claims, 9 Drawing Sheets

PORTABLE RAILCAR STEP AND RAILCAR THEREWITH

CROSS-REFERENCE TO RELATED APPLICATIONS

This application is a continuation-in-part patent application of U.S. patent application Ser. No. 11/520,536, filed Sep. 13, 2006, the disclosure of which is incorporated herein by reference.

BACKGROUND OF THE INVENTION

This invention relates in general to land vehicles and more particularly to railway vehicles.

A railway vehicle, as shown in FIG. 1, may include a railcar 10 having a body 14 and wheels 16 for supporting the railcar 10 for movement along rails. The railcar 10 is largely used for hauling. A plurality of railcars 10 may be coupled together to form a train, which may be hauled by a locomotive. Handholds 18 in a ladder rung arrangement may be mounted on the side of the body 14 near a corner of the body 14. A sill step or stirrup 20 may be mounted to the corner of the railcar 10 just beneath the body 14 and inward of the handholds 18. The handholds 18 may be provided for a rail worker to grip while ascending or descending the stirrup 20. The stirrup 20 maybe in the form of a U-shaped structure formed from substantially flat metal stock and having a lower step member and a leg extending upwardly from opposing ends of the step member. A rail worker may stand on the stirrup 20 and hold onto a handhold 18 as the railcar 10 is transported around a rail yard. The rail worker when standing on the stirrup 20 must lean outward at an angle because the stirrup 20 is mounted inward of the railcar 10.

SUMMARY OF THE INVENTION

This invention relates to a railcar step for mounting to the stirrup of a railcar. The railcar step may be comprised of a support for supporting a rail worker. A coupling may be supported in relation to an end of the support. The coupling may be sized and configured to hold the support in fixed relation to the stirrup. The support is sized to extend outward beyond the railcar.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1:
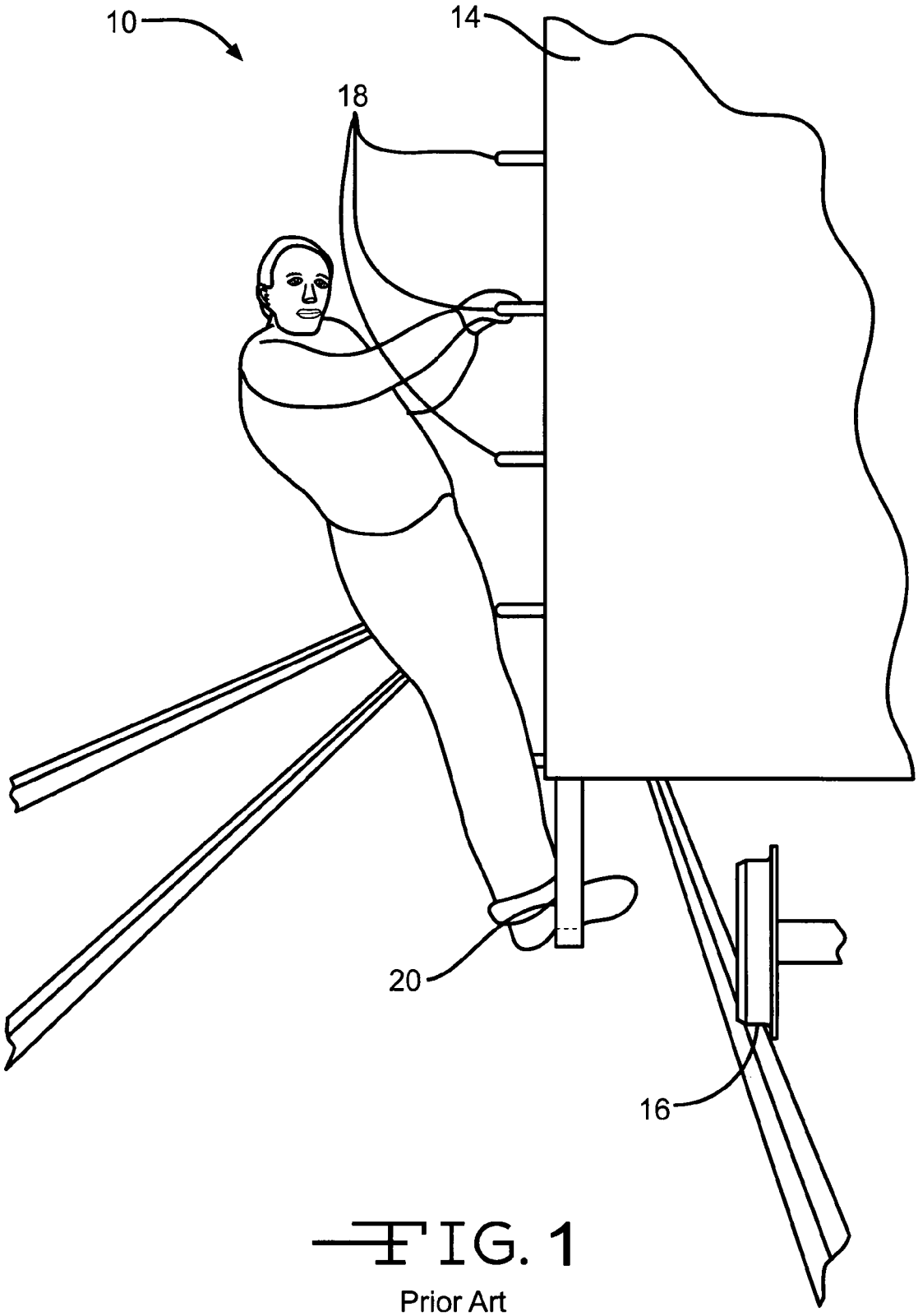
FIG. 1 Prior Art
FIG. 1 is a partial environmental rear elevational view of a prior art railcar step.
Figure 2:
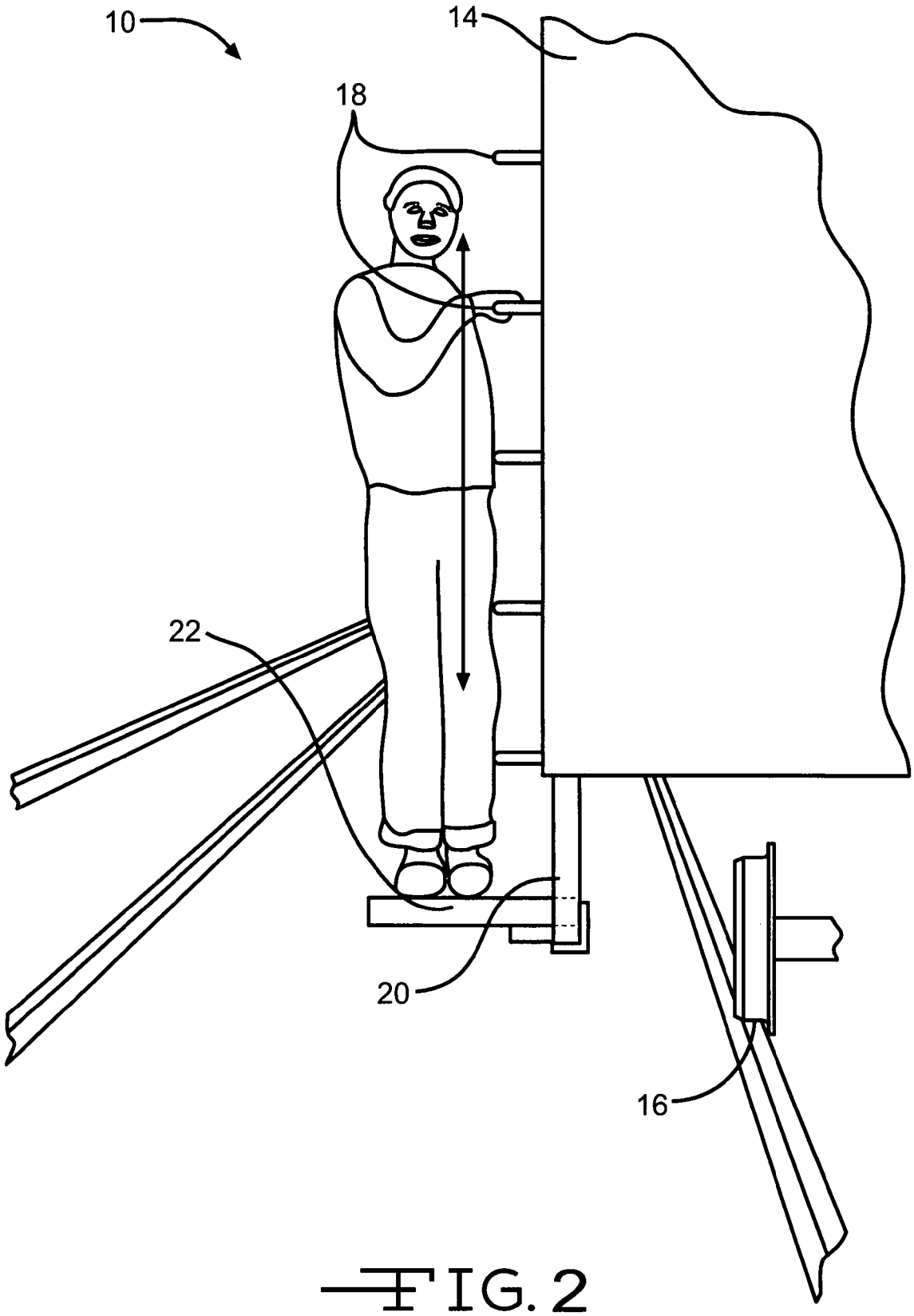
FIG. 2 is a partial environmental rear elevational view of a railcar step according to one embodiment of the invention.

Referring now to the drawings, there is illustrated in FIG. 2 a rail railcar 10 having a body 14 and wheels 16 for supporting the railcar 10 for movement along rails. Handholds 18 are mounted in a ladder rung arrangement on the side of the body 14 near a corner of the body 14. A stirrup 20 is mounted to the corner of the railcar 10 just beneath the body 14 and inward of the handholds 18. A railcar step 22 is mounted to the stirrup 20. The railcar step 22 is sized to extend outward beyond the side of the body 14 so that a rail worker may stand on the railcar step 22 and hold onto a handhold 18 without leaning outward at a substantial angle, as is required without the railcar step 22.

Figure 3:
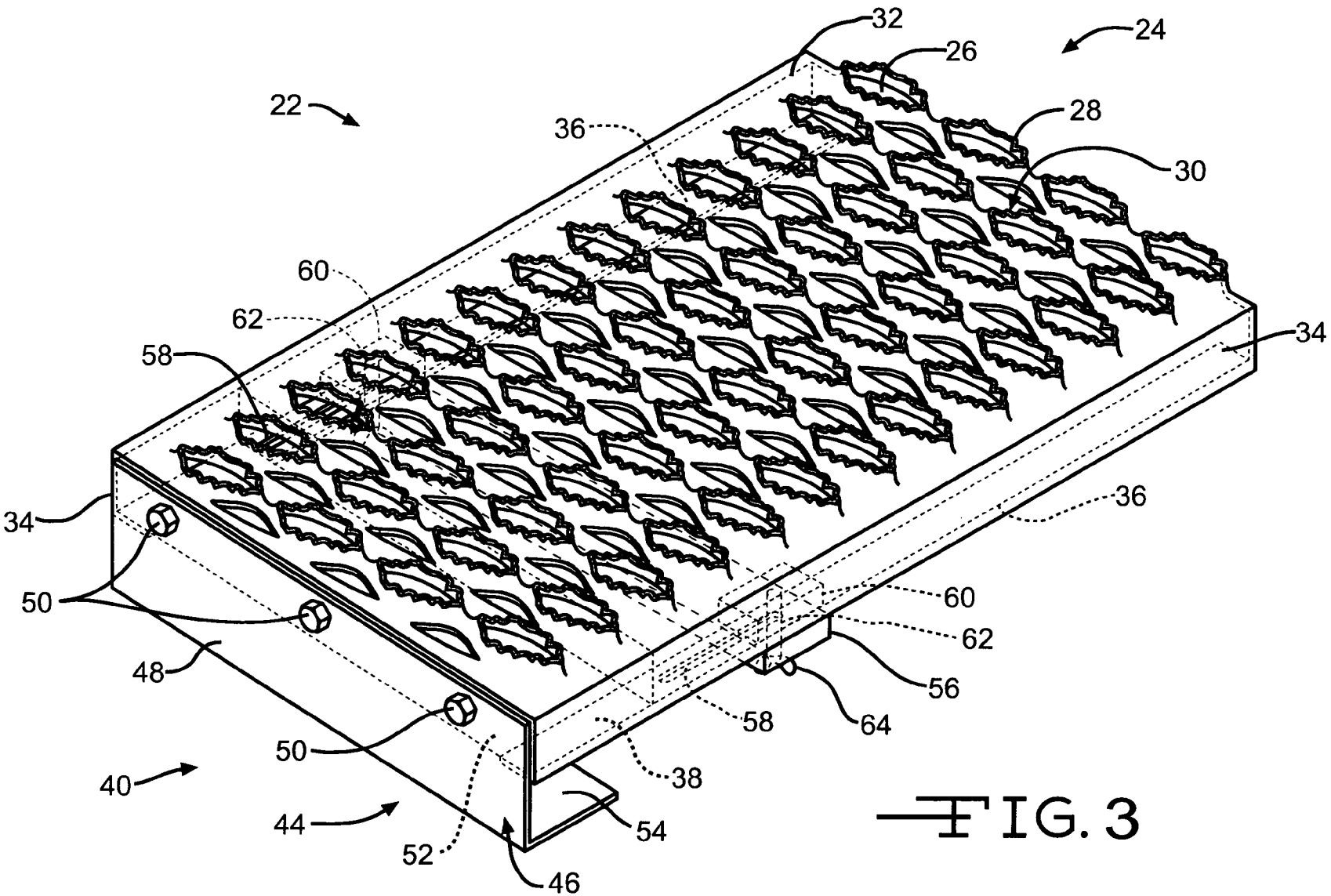
FIG. 3 is an enlarged front perspective view of the railcar step shown in FIG. 2.

As shown in FIG. 3, the railcar step 22 comprises a support, such as a plank grating 24, such as the GRIP STRUT® plank grating manufactured by McNichols of Atlanta, Ga., U.S.A. Such a plank grating 24 has diamond-shaped openings 26 with serrated teeth 28 providing a safe, slip resistant surface, generally indicated at 30, that grabs in all or nearly all directions. The surface 30 is ideally suited for most if not all inside and outside conditions—and is resistant to effects or collection of grease, snow, mud, ice, detergent, etc. The openings 26 are small enough to catch most falling items, such as tools. The plank grating 24 also has a high load capacity and a long life.

Although the general shape of the plank grating 24 may take other forms, the illustrated plank grating 24 has an inverted generally U-shaped cross-section that comprises a top 32 and opposing sides 34 with inwardly rolled lips 36 along the bottom of both sides 34. The plank grating 24 should be sufficiently wide to provide ample support for a rail worker and sufficiently long to extend beyond the side of the rail vehicle body 14. For example, a plank grating that is about 9 inches (22.86 cm) wide and 16 inches (40.64 cm) long is sufficiently wide and sufficiently long.

The plank grating 24 is preferably aluminum, galvanized, stainless steel, or plain steel, although other plank gratings, including but not limited to those formed of composite materials, may be suitable. The thickness of the plank grating 24 may be dependent on the material from which the plank grating 24 is formed, but for the metals described above, the plank grating 24 may be about 12-16 gauge.

It should be appreciated that the plank grating 24 shown and described above is merely exemplary support and that other supports may be suitable.

Figure 4:
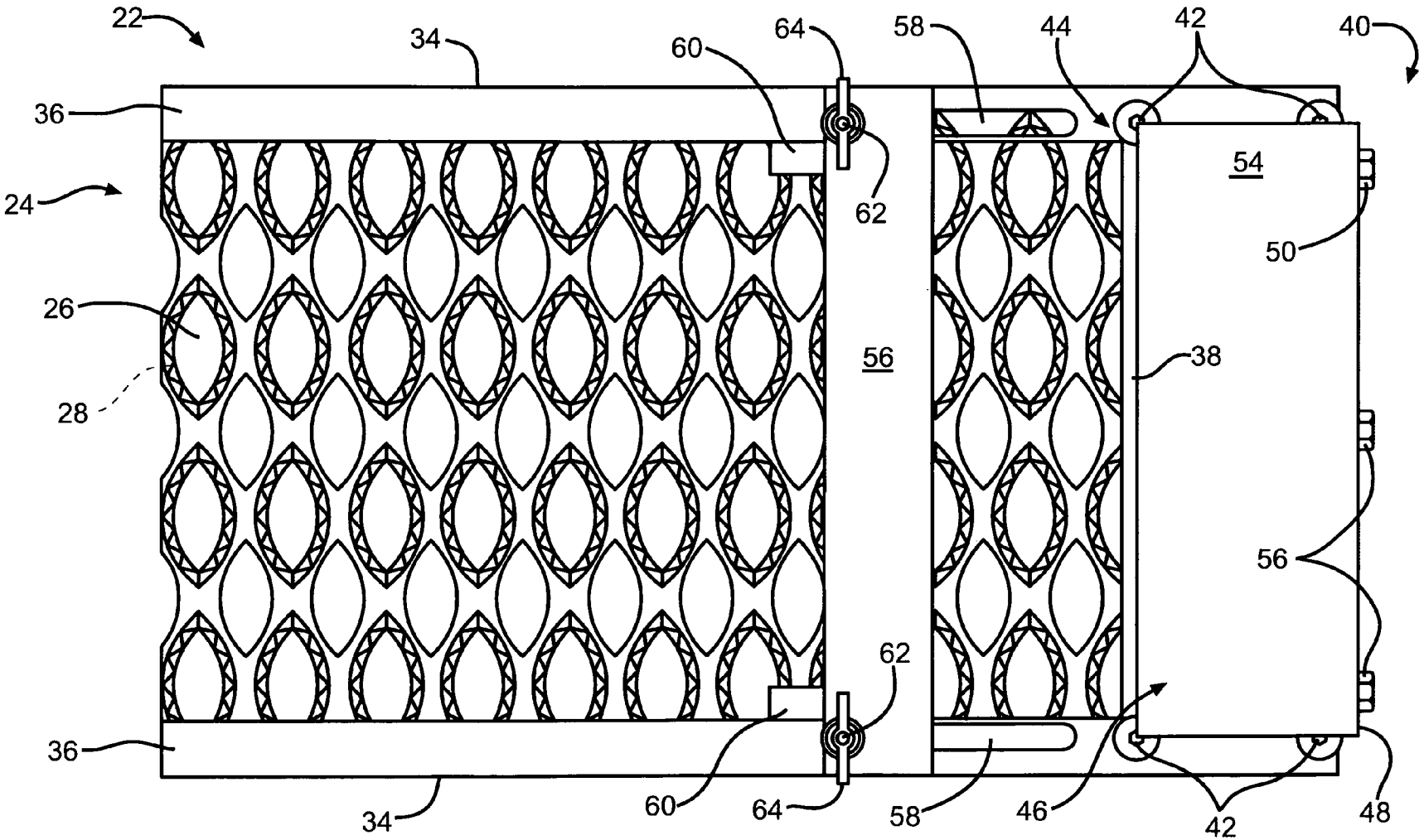
FIG. 4 is an enlarged bottom plan view of the railcar step shown in FIG. 3.

A block of material 38 may be inserted in one end, generally indicated at 40, of the plank grating 24, so as to be captured by the inverted generally U-shaped cross-section (i.e., within the top 32, opposing sides 34 and inwardly rolled lips 36). The block of material 38 may be mounted to the inwardly rolled lips 36 of the plank grating 24, such as by threaded fasteners 42, as shown in FIG. 4, that pass through holes (not shown) in the inwardly rolled lips 36 and thread into threaded holes (not shown) in an underside of the block of material 38. The block of material 38 and the manner in which it is attached are merely provided as an example of an embodiment for mounting a hook 44 to the end 40 of the plank grating 24.

The hook 44 may be formed by an L-shaped member, generally indicated at 46. A first leg 48 of the L-shaped member 46 may be mounted to the block of material 38, such as by threaded fasteners 50 that pass through holes (not shown) in the first leg 48 and thread into threaded holes (not shown) in an exposed side 52 of the block of material 38. A second leg 54 of the L-shaped member 46 may extend beneath the end 40 of the plank grating 24, in spaced relation to the bottom of the plank grating 24. The spaced relation may provide sufficient space between the plank grating 24 and the second leg 54 of the L-shaped member 46 to receive the railcar stirrup 20 therebetween, and thus forms a receiver. The space preferably permits ease of placement of the stirrup 20 in the space yet holds the stirrup 20 substantially secure therein. It should be appreciated that the hook 44 may take on other shapes and may be mounted to the plank grating 24 in any suitable manner, such as by welding or otherwise to the block of material 38 or directly to the end 40 of the plank grating 24, in which case it may be possible to omit the block of material 38.

It is contemplated that the stirrup 20 be retained in the space described above to hold the plank grating 24 in a substantially fixed relation to the stirrup 20. This may be accomplished in any suitable manner. For example, a retainer, such as a bar 56 or other suitable member, may be supported for movement in relation to the plank grating 24. The illustrated bar 56 may extend in the width direction of the plank grating 24, substantially parallel to the hook 44.

The bar 56 may be mounted in sliding relation to the inwardly rolled lips 36 along the bottom of both sides 34 of the plank grating 24. This may be accomplished, for example, by providing slots 58 in the inwardly rolled lips 36 that extend lengthwise of the plank grating 24. Sliding blocks 60 may be provided above the inwardly rolled lips 36 and threaded fasteners 62, which may be held in fixed relation to the sliding blocks 60 and extend from the sliding blocks 60 through the slots 58 and further through holes (not shown) in the bar 56. Wing nuts 64, or other suitable mating fasteners, may be tightened onto the threaded fasteners 62 to retain the bar 56 in sliding relation to the plank grating 24 and further tightened to hold the bar 56 in a fixed relation to the plank grating 24 and in close proximity to the hook 40 to retain the stirrup 20.

In operation, the plank grating 24 may be removably coupled to the stirrup 20 by hooking the hook 44 inwardly behind and beneath the stirrup 20 with the plank grating 24 extending over the stirrup 20 and outward beyond the side of the body 14. With the wing nuts 64 loosened, the bar 56 may be slid in relation to the plank grating 24 in close proximity to the hook 40 to trap the stirrup 20 thereby. Then, the wing nuts 64 may be tightened to hold the bar 56 in a fixed relation to the plank grating 24 and retain the stirrup 20. Accordingly, the plank grating 24 may support a rail worker, as shown in FIG. 2, so that rail worker may stand on the railcar step 22 and hold onto a handhold 18 without leaning outward at a substantial angle.

The plank grating 24 may be removed simply by loosening the wing nuts 64, sliding the bar 56 away from the hook 44 to permit removal of the stirrup 20, and then by unhooking the railcar step 22.

The railcar step 22 may be easily removed, and may be sized and sufficiently lightweight to permit the railcar step 22 to be easily transported.

It should be appreciated that the retainer is not intended to be limited to the sliding bar 56 shown and described, and that other forms of retainers may be suitable for holding the plank grating 24 in a substantially fixed relation to the stirrup 20 may be employed.

It should also be appreciated that the fasteners are not intended to be limited to the wing nuts 64 shown and described, and that other forms of fasteners may be suitable for retaining the bar 56 in sliding relation to the plank grating 24 and holding the bar 56 in a fixed relation to the plank grating 24.

It should also be appreciated that fasteners may be employed with other fasteners or used independently of other fasteners.

Figure 5:
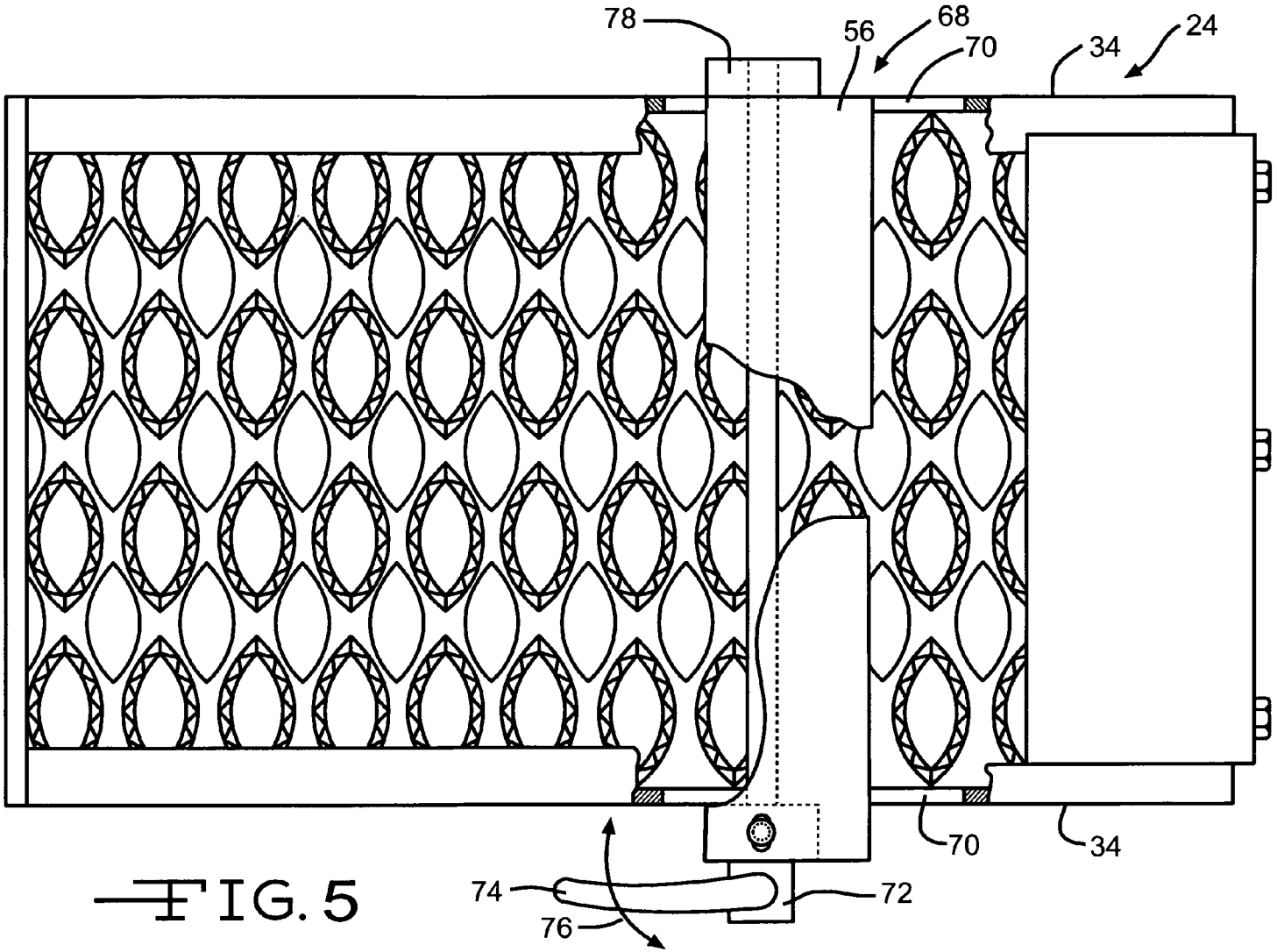
FIG. 5 is a bottom plan view of the railcar step that employs a quick release mechanism.

An example of another fastener is shown in FIG. 5. This fastener is in the form of a quick release mechanism. The quick release mechanism may include a skewer 68, such as that conceived in 1927 by Tullio Campagnolo, an Italian bicycle racer. The skewer 68 may pass through slots 70 in the opposing sides 34 of the plank grating 24. The slots 70 may permit the skewer 68 to move (i.e., in left and right directions when viewing FIG. 5) in relation to the plank grating 24. The skewer 68 may be supported in relation to the bar 56 so that movement of the skewer 68 translates into movement of the bar 56.

The skewer 68 may feature a cam (not shown) supported by a body 72. The body 72 may move (i.e., in a vertical direction when viewing FIG. 5) via displacement of a lever 74, such as along the line 76 shown. The body 72 may be provided with teeth (not shown) that may press against one of the opposing sides 34 of the plank grating 24. An acorn nut 78, which may be threaded onto an opposite end of the skewer 68, may press against the other side 34 of the plank grating 24. Displacement of the lever 74 may release the body 72 and the acorn nut 78 from engagement with the opposing sides 34 of the plank grating 24 to permit movement of the skewer 68 and the bar 56.

Figure 6:
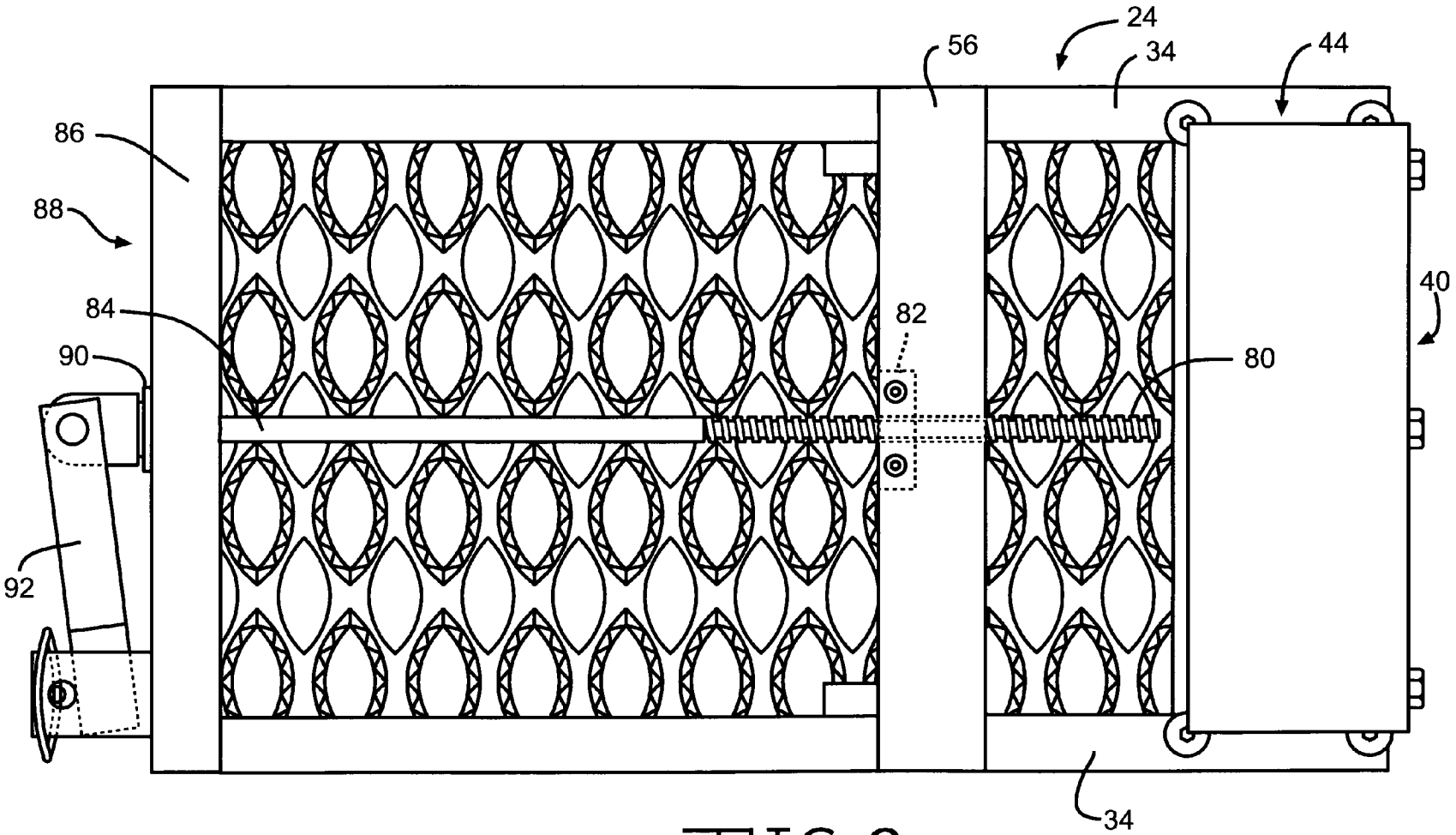
FIG. 6 is a bottom plan view of the railcar step that employs a screw thread arrangement.

Another example of a fastener is shown in FIG. 6. This fastener is in the form of a screw thread 80 that may be supported in relation to the bar 56, such as through the provision of a threaded block 82, which is configured to cooperate with the screw thread 80. The screw thread 80 may be an ACME screw thread or some other suitable thread configuration. The screw thread 80 may be supported by a rod 84 or other suitable structure. The rod 84 may be supported for rotational movement in a substantially fixed axial relation to the plank grating 24. Although this may be accomplished in any suitable manner, a cross member 86 may be supported in relation is an opposing end 88 of the plank grating 24 and the rod 84 may be supported for rotational movement in a substantially axially fixed relation to the cross member 86. This may be accomplished with any suitable supporting structure, such as the bearing 90 shown.

A handle 92 may be pivotally or otherwise supported in relation to the rod 84 to aid in rotating the rod 84 and thus thread the screw thread 80 in relation to the threaded block 82, which in turn displaces the bar 56 (i.e., to the left and right when viewing FIG. 6). This may permit an axial force to be applied to the bar 56 to force the bar 56 into engagement with the stirrup 20 and hold the stirrup 20 in a substantially fixed relation to the hook 44 at the end 40 of the plank grating 24.

Figure 6A:
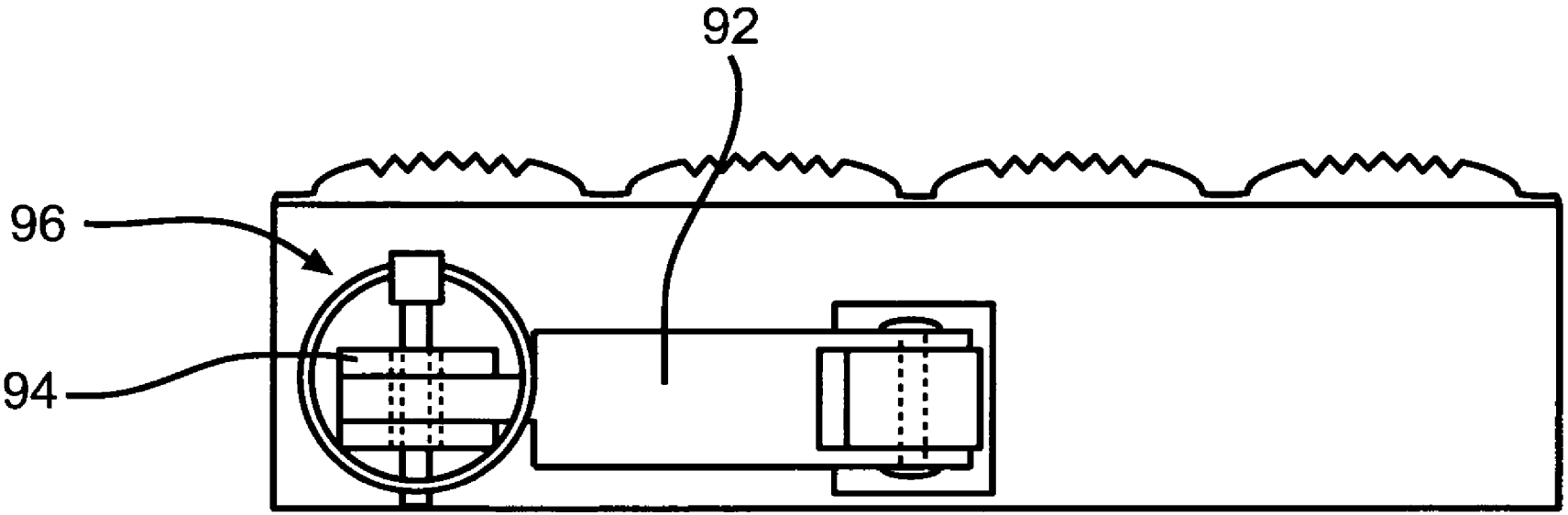
FIG. 6A is an end view of the railcar step shown in FIG. 6.

As shown in FIG. 6A, the handle 92 may be pivotally displaced so as to be moved in close proximity to the cross member 86. The handle 92 may be held in this position via a receiver 94 or other suitable structure, for example by any suitable fastener, such as the farmer's clip 96 shown.

Figure 7:
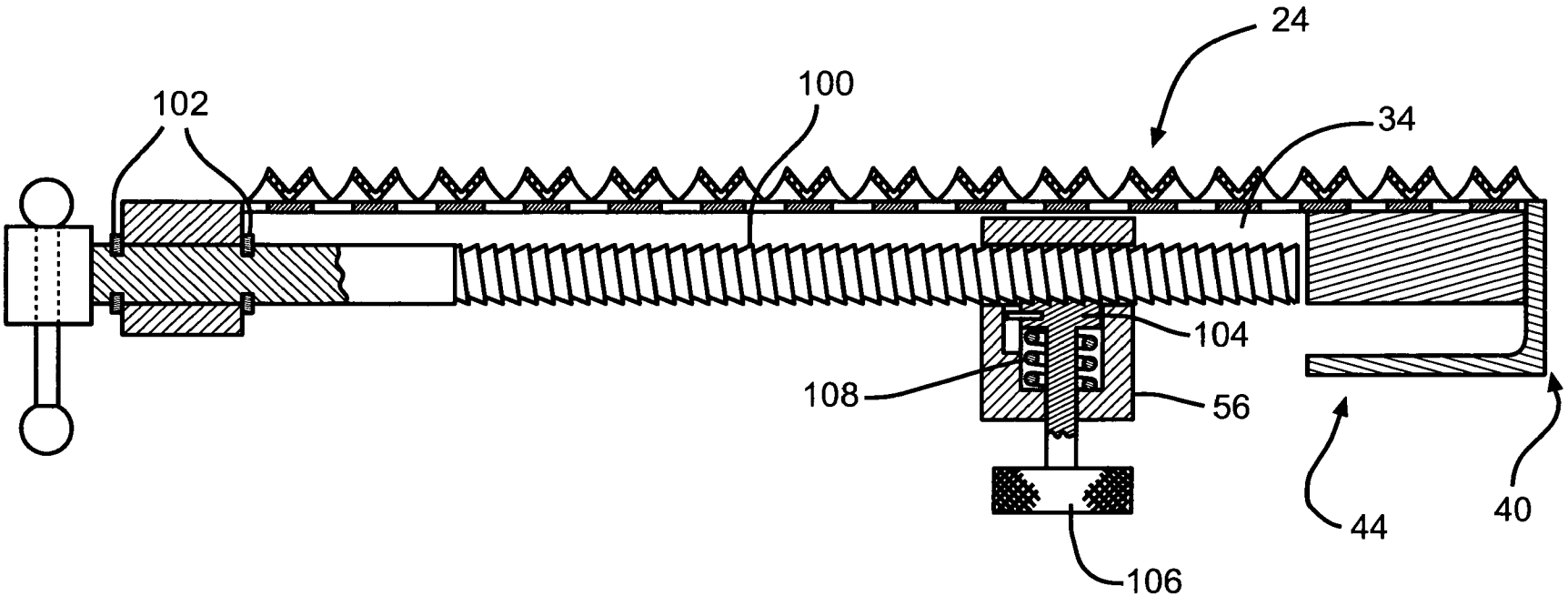
FIG. 7 is a sectional view of the railcar step that employs a retainer in the form of a quick clamping vise arrangement.
Figure 8:
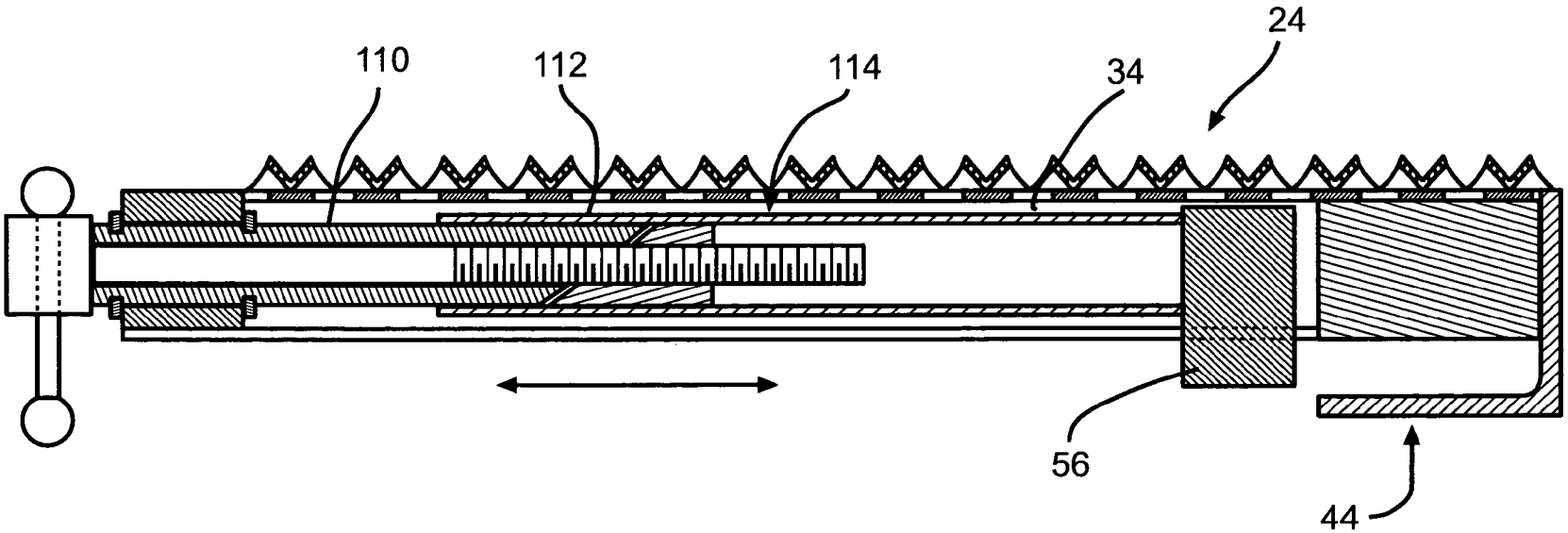
FIG. 8 is a sectional view of the railcar step that employs a telescoping arrangement.

It should be appreciated that the fastener may cooperate with the bar 56 to form a quick clamping vise. An example of a quick clamping vise is shown and described in U.S. Pat. No. 2,445,188, issued in 1948 to Anthony Sasgen, the disclosure of which is incorporated herein by reference. A quick clamping vise arrangement is shown in FIG. 7. A screw thread 100 may be held in a substantially fixed axial relation to the cross member 86 at the end 88 of the plank grating 24. This may be accomplished in any suitable manner, such as by the retention clips 102 shown. A ratchet structure 104 supported in relation to the bar 56 may permit the bar 56 to move in sliding relation to the screw thread 100 (i.e., to the left and right when viewing FIG. 7) so that the bar 56, which may be connected for sliding movement to the opposing sides 34 of the plank grating 24, may be readily moved in relation to the hook 44 and the stirrup 20 without rotating the screw thread 100. With the bar 56 and the stirrup 20 engaged or in close proximity, the screw thread 100 may be rotated to tighten the bar 56 against the stirrup 20 to hold the stirrup 20 firmly in relation to the hook 44. The screw thread 100 may be released from the ratchet structure 104, for example, by displacing a release structure, such as the plunger 106 shown. Upon releasing the plunger 106, the ratchet structure 104 may be biased back into engagement with the screw thread 100 by a helical spring 108, or other suitable biasing element.

It should be appreciated that fasteners other than the fastener described above may be employed. For example, the fastener may be comprised of telescoping members 110, 112, including a first member 110 that is substantially fixed in relation to the plank grating 24 and a second member 112 is movable in relation to the first member 110. A bar 56 for retaining the stirrup 20 in relation to the hook 44 may be connected for sliding movement to the opposing sides 34 of the plank grating 24 and supported by the second member 114 so as to move with the second member 114. The telescoping members may be held in fixed relation to one another in any suitable fashion, such as by the provision of one or more members, generally indicated at 114, that may cooperate or otherwise be structured or function to effectively frictionally restrict movement of the telescoping members 110, 112 relative to one another. Such frictionally restricted movement may be accomplished, for example, by structure similar to that employed for retaining a bicycle handlebar gooseneck in position within a relative portion of a bicycle frame. Such structure is shown for example in U.S. Pat. No. 4,068,858, issued in 1978, to George Harrison, and U.S. Pat. No. 4,252,335, issued in 1981, to Richard K. Brenner, the disclosures of which are incorporated herein by reference.

The principle and mode of operation of this invention have been explained and illustrated in its preferred embodiment. However, it must be understood that this invention may be practiced otherwise than as specifically explained and illustrated without departing from its spirit or scope.

What is claimed is:

1. A rail vehicle step in combination with a rail vehicle, comprising:

a rail vehicle comprising:

a rail vehicle body;

wheels supporting the rail vehicle body for movement along rails;

handholds mounted to the rail vehicle body; and a stirrup mounted to the rail vehicle body beneath the rail vehicle body and inward of the handholds, and a rail vehicle step for releasably mounting to a stirrup, the rail vehicle step comprising:

a plank having a width and a length, a hook mounted in relation to the plank, the hook extending beneath the plank wherein a space between the plank and the hook is defined for receiving the stirrup, a bar extending in the width direction of the plank, substantially parallel in relation to the hook, the bar being mounted so as to slide in relation to opposing sides of the plank, a screw thread being supported for rotational movement in a substantially fixed axial relation to the plank, whereby rotation of the screw thread in relation to the plank displaces the bar and applies force to the bar to force the bar into engagement with the stirrup to hold the stirrup in engagement with the hook, the length of the plank being dimensioned to extend from the stirrup to beyond the rail vehicle, a handle supported in relation to the screw thread to aid in rotating the screw thread in relation to the bar.

2. The rail vehicle step of claim 1, further comprising a ratchet structure supported in relation to the screw thread to permit the bar to move in sliding relation to the hook and stirrup without rotating the screw thread, and the screw thread being releasable from the ratchet structure.

3. The rail vehicle step of claim 2, wherein the screw thread is releasable from the ratchet structure by displacing a plunger, the ratchet structure being biased back into engagement with the screw thread by a biasing element upon releasing the plunger.

4. A rail vehicle step in combination with a rail vehicle, comprising:

a rail vehicle comprising:

a body with a side, wheels for supporting the body for movement along rails, a ladder rung arrangement mounted on the side of the body, and a stirrup mounted beneath the body, inward of the ladder rung arrangement; and a rail vehicle step for releasably mounting to the stirrup, the rail vehicle step comprising:

a plank grating having a width and a length; and a hook supported in relation to the plank grating, the hook spaced from the plank grating so as to receive the stirrup of the rail vehicle between the hook and the plank grating;

a bar being supported so as to slide in relation to the plank grating, and a screw thread supported for rotational movement in a substantially fixed axial relation to the plank grating, the screw thread configured to hold the bar from movement in relation to the plank grating to retain the stirrup in the hook, a handle supported in relation to the screw thread to aid in rotating the screw thread, which in turn displaces the bar to force the bar into engagement with the stirrup and hold the stirrup in a substantially fixed relation to the hook, wherein the length of the plank grating extends from the stirrup to beyond the side of the body so that a rail worker can stand on the plank grating and hold onto the ladder rung arrangement without leaning outward at a substantial angle in relation to the body.

5. The rail vehicle step of claim 4, wherein the hook has a leg that extends beneath an end of the plank grating in spaced relation to the plank grating to provide space between the plank grating and the leg for receiving the rail vehicle stirrup.

6. The rail vehicle step of claim 4, wherein the bar extends in a widthwise direction of the plank grating and substantially parallel to the hook, the bar being releasably held in fixed relation to the hook by the screw thread so that the bar retains the stirrup in the hook.

7. The rail vehicle step of claim 4, wherein the bar is connected for sliding movement to opposing sides of the plank grating and the screw thread is supported in relation to the bar via a threaded block, the screw thread being supported for rotational movement in a substantially fixed axial relation to the plank grating, whereby rotation of the screw thread in relation to the threaded block displaces the bar and applies axial force to the bar to force the bar into engagement with the stirrup to hold the stirrup in the hook.

8. The rail vehicle step of claim 7, wherein the handle is supported in pivotal relation to the screw thread.

9. A rail vehicle step in combination with a rail vehicle, comprising:

a rail vehicle comprising:

a body, wheels for supporting the body for movement along rails, a ladder rung arrangement mounted in relation to the body, and a stirrup mounted beneath the body, inward of the ladder rung arrangement; and a rail vehicle step for releasably mounting to the stirrup, the rail vehicle step comprising:

a plank having a width and a length, the plank having a top, opposing sides, inwardly rolled lips defining opposing channels, and the plank having an end, a hook having a first leg mounted in relation to the plank and a second leg extending from the first leg in spaced relation to the plank to define a space between the plank and the second leg of the hook to receive the rail vehicle stirrup, a bar extending in the width direction of the plank, substantially parallel to the hook, the bar being mounted so as to slide in relation to the opposing channels, a screw thread supported for rotational movement in relation to the plank, whereby rotation of the screw thread displaces the bar and applies axial force to the bar so that the bar can be forced into engagement with the stirrup to hold the stirrup in the hook, and a handle supported in relation to the screw thread to aid in rotating the screw thread in relation to the bar, the handle releasably held in position against rotation by a receiver, and wherein the length of the plank is dimensioned so that the plank extends outward beyond the body of the rail vehicle so that a rail worker can stand on the plank and hold onto the ladder rung arrangement without leaning outward at a substantial angle in relation to the body.

10. The rail vehicle step of claim 9, wherein the hook is formed at least in part by an L-shaped member.

11. The rail vehicle step of claim 9, wherein the plank has diamond-shaped openings with serrated teeth.

12. The rail vehicle step of claim 9, wherein the plank is about 9 inches wide and about 16 inches long.

13. The rail vehicle step of claim 9, wherein the plank is aluminum, galvanized, stainless steel, plain steel, or a combination thereof.

* * * * *